US005346797A

United States Patent [19]

Kmiecik-Lawrynowicz et al.

[11] Patent Number: 5,346,797

[45] Date of Patent: Sep. 13, 1994

[54] TONER PROCESSES

[75] Inventors: Grazyna E. Kmiecik-Lawrynowicz, Burlington; Raj D. Patel; Guerino G. Sacripante, both of Oakville, all of Canada

[73] Assignee: Xerox Corporation, Stamford, Conn.

[21] Appl. No.: 22,575

[22] Filed: Feb. 25, 1993

[51] Int. Cl.[5] ..... G03G 9/087

[52] U.S. Cl. ..... 430/137; 430/110

[58] Field of Search ..... 430/106, 108, 110, 137

[56] References Cited

U.S. PATENT DOCUMENTS

| | | | |
|---|---|---|---|
| 4,558,108 | 12/1985 | Alexander et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,153,090 | 10/1992 | Swidler | 430/115 |
| 5,164,282 | 11/1992 | Mahabadi | 430/137 |

*Primary Examiner*—John Goodrow
*Attorney, Agent, or Firm*—E. O. Palazzo

[57] ABSTRACT

A process for the preparation of toner compositions comprising (i) preparing a pigment dispersion in a solvent, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles to form said toner composition comprised of polymeric resin, pigment and optionally a charge control agent.

28 Claims, No Drawings

TONER PROCESSES

BACKGROUND OF THE INVENTION

The present invention is generally directed to toner processes, and more specifically, to aggregation and coalescence processes for the preparation of toner compositions. In embodiments, the present invention is directed to the economical preparation of toners without the utilization of the known pulverization and/or classification methods, and wherein toners with an average volume diameter of from about 1 to about 25 and preferably from 1 to about 10 microns, and narrow GSD characteristics can be obtained. The resulting toners can be selected for known electrophotographic imaging and printing processes, including color processes and lithography. In embodiments, the present invention is directed to a process comprised of dispersing a pigment and optionally a charge control agent or additive in an aqueous mixture containing an ionic surfactant, and shearing this mixture with a latex mixture, comprised of suspended resin particles of from about 0.05 micron to about 2 microns in volume diameter, in an aqueous solution containing a counterionic surfactant with opposite charge to the ionic surfactant of the pigment dispersion and nonionic surfactant, thereby causing a flocculation of resin particles, pigment particles and optional charge control particles, followed by stirring of the flocculent mixture, which is believed to form statically bound aggregates of from about 0.5 micron to about 5 microns, comprised of resin, pigment and optionally charge control particles, and thereafter heating to generate toners with an average particle volume diameter of from about 1 to about 25 microns. It is believed that during the heating stage, the aggregate particles fuse together to form toners. In another embodiment thereof, the present invention is directed to an in situ process comprised of first dispersing a pigment, such as HELIOGEN BLUE TM or HOSTAPERM PINK TM, in an aqueous mixture containing a cationic surfactant such as benzalkonium bromide (SANIZOL B-50 TM), utilizing a high shearing device such as a Brinkman Polytron, or microfluidizer or sonicator; thereafter shearing this mixture with a latex of suspended resin particles, such as PLIOTONE TM, comprised of styrene butadiene and of particle size ranging from 0.01 to about 0.5 micron as measured by the Brookhaven nanosizer, in an aqueous surfactant mixture containing an anionic surfactant, such as sodium dodecylbenzene sulfonate (for example NEOGEN R TM or NEOGEN SC TM), and nonionic surfactant such as alkyl phenoxy poly(ethylenoxy)ethanol (for example IGEPAL 897 TM or ANTAROX 897 TM), thereby resulting in a flocculation, or heterocoagulation of the resin particles with the pigment particles; and which on further stirring results in formation of statically bound aggregates ranging in size of from about 0.5 micron to about 10 microns in average diameter size as measured by the Coulter Counter (Microsizer II); and thereafter, heating to provide for particle fusion or coalescence of the polymer and pigment particles; followed by washing with, for example, hot water to remove surfactant, and drying whereby toner particles comprised of resin and pigment with various particle size diameters can be obtained, such as from 1 to 12 microns in average volume particle diameter. The aforementioned toners are especially useful for the development of colored images with excellent line and solid resolution, and wherein substantially no background deposits are present. While not being desired to be limited by theory, it is believed that the flocculation or heterocoagulation is formed by the neutralization of the pigment mixture containing the pigment and cationic surfactant absorbed on the pigment surface, with the resin mixture containing the resin particles and anionic surfactant absorbed on the resin particle. The high shearing stage disperses the big initially formed flocculants, and speeds up formation of stabilized aggregates negatively charged and comprised of the pigment and resin particles of about 0.5 to about 5 microns in volume diameter. Thereafter, heating is applied to fuse the aggregated particles or coalesce the particles to toner composites. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by homogenization; and form statically bound aggregate particles by stirring of the homogeneous mixture and toner formation after heating.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with an average volume particle of less than 11 microns and preferably less than about 7 microns, and with narrow geometric size distribution (GSD) of from about 1.2 to about 1.3. Additionally, in some xerographic systems wherein process color is utilized such as pictorial color applications, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes such as from about 1 to 7 microns and with higher pigment loading, such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is preferred, low gloss paper is utilized, such as from about 1 to about 30 gloss units as measured by the Gardner Gloss metering unit, and which after image formation with small particle size toners of from about 3 to about 5 microns and fixing thereafter results in a low gloss toner image of from about 1 to about 30 gloss units as measured by the Gardner Gloss metering unit. Alternatively, if higher image gloss is desired, such as from about 30 to about 60 gloss units as measured by the Gardner Gloss metering unit, higher gloss paper is utilized such as from about 30 to about 60 gloss units, and which after image formation with small particle size toners of the present invention of from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns, and with broad geometric size distribution of from about 1.4 to about 1.7. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 5 microns are attained without resorting to classification processes, and where in narrow geometric size distributions are attained, such as from about 1.16 to about 1.35, and preferably from about 1.16 to about 1.30. High toner yields are also attained such as from about 90 percent to about 98 percent in embodiments. In addition, by the toner particle preparation process of this invention, small particle size toners of from about 3 microns to about 7 microns can be economically prepared in high yields such as from about 90 percent to about 98 percent by weight based on the weight of all the toner material ingredients.

There is illustrated in U.S. Pat. No. 4,996,127 a toner of associated particles of secondary particles comprising primary particles of a polymer having acidic or basic polar groups and a coloring agent. The polymers selected for the toners of this U.S. Pat. No. '127 patent can be prepared by an emulsion polymerization method, see for example columns 4 and 5 of this patent. In column 7 of this U.S. Pat. No. '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer such as acrylic acid in the emulsion resin is necessary, and toner preparation is not obtained without the use, for example, of acrylic acid polar group, see Comparative Example I. The process of the present invention need not utilize a polymer with polar acid groups, and toners can be prepared with resins, such as styrene butadiene or PLIOTONE TM, without containing polar acid groups. Additionally, the toner of the U.S. Pat. No. '127 patent does not utilize counterionic surfactant and flocculation process as does the present invention. In U.S. Pat. No. 4,983,488, a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with wide GSD. Furthermore, the U.S. Pat. No. '488 patent does not disclose the process of counterionic flocculation as the present invention. Similarly, the aforementioned disadvantages are noted in other prior art, such as U.S. Pat. No. 4,797,339, wherein there is disclosed a process for the preparation of toners by resin emulsion polymerization, wherein similar to the U.S. Pat. No. '127 patent polar resins of opposite charge are selected, and wherein flocculation as in the present invention is not disclosed; and U.S. Pat. No. 4,558,108, wherein there is disclosed a process for the preparation of a copolymer of styrene and butadiene by specific suspension polymerization. Other patents mentioned are Nos. 3,674,736; 4,137,188 and 5,066,560.

In U.S. Pat. No. 5,290,654, the disclosure of which is totally incorporated herein by reference, there is disclosed a process for the preparation of toners comprised of dispersing a polymer solution comprised of an organic solvent and a polyester, and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising a halogenization procedure which chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron, nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution of from about 1.2 to about 1.4, as measured by the Coulter Counter, and which exhibit, for example, low fixing temperature of from about 125° C. to about 150° C., low paper curling, and image to paper gloss matching.

In copending patent application U.S. Ser. No. 989,613 (D/92576), the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process, comprised of (i) preparing a cationic pigment mixture containing pigment particles, and optionally charge control agents and other known optional additives dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation or heterocoagulation, which on further stirring allows the formation of electrostatically stable aggregates of from about 0.5 to about 5 microns in volume diameter as measured by the Coulter Counter; and (iii) coalescing or fusing the aggregate particle mixture by heat to toner composites, or a toner composition comprised of resin, pigment, charge additive.

In a further object of the present invention there is provided a process for the preparation of toners with an average particle diameter of from between about 1 to about 50 microns, and preferably from about 1 to about 7 microns, and with a narrow GSD of from about 1.2 to about 1.35 and preferably from about 1.2 to about 1.3 as measured by the Coulter Counter.

Moreover, in a further object of the present invention there is provided a process for the preparation of toners which after fixing to paper substrates result in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, or the aggregation of MICR suspension particles with pigment particles dispersed in water and surfactant, and wherein the aggregated particles, of toner size, can then be caused to coalesce by, for example, heating. In embodiments, factors of importance with respect to controlling particle size and GSD include the concentration of the surfactant used for the pigment dispersion, concentration of the component, like acrylic acid in the latex, the temperature of coalescence, and the time of coalescence.

These and other objects of the present invention are accomplished in embodiments by the provision of toners and processes thereof. In embodiments of the present invention, there are provided processes for the economical direct preparation of toner compositions by a flocculation or heterocoagulation, and coalescence processes.

In embodiments, the present invention is directed to processes for the preparation of toner compositions which comprises initially attaining or generating an ionic pigment dispersion, for example dispersing an aqueous mixture of a pigment or pigments such as phthalocyanine, quinacridone or Rhodamine B type with a cationic surfactant such as benzalkonium chloride by utilizing a high shearing device such as a Brinkman Polytron, thereafter shearing this mixture by utilizing a high shearing device such as a Brinkman Polytron, or sonicator or microfluidizer with a suspended resin mixture comprised of polymer particles such as styrene butadiene or styrene butylacrylate and of particle size ranging from 0.01 to about 0.5 micron in an aqueous surfactant mixture containing an anionic surfactant such as sodium dodecylbenzene sulfonate and nonionic surfactant; resulting in a flocculation or heterocoagulation of the resin particles with the pigment particles caused by the neutralization of cationic surfactant absorbed on the pigment particle with the oppositely charged anionic surfactant absorbed on the resin particles; and further stirring the mixture using a mechanical stirrer at 250 to 500 rpm and allowing the formation of electrostatically stabilized aggregates ranging from about 0.5 micron to about 10 microns; and heating from about 60° to about 95° C. to provide for particle fusion or coalescence of the polymer and pigment particles; followed by washing with, for example, hot water to remove surfactant, and drying such as by use of an Aeromatic fluid bed dryer whereby toner particles comprised of resin and pigment with various particle size diameters can be obtained, such as from about 1 to about 10 microns in average volume particle diameter as measured by the Coulter Counter.

Embodiments of the present invention include a process for the preparation of toner compositions comprising (i) preparing a pigment dispersion in a solvent, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles to form said toner composition comprised of polymeric resin, pigment and optionally a charge control agent.

Also, in embodiments the present invention is directed to processes for the preparation of toner compositions which comprises (i) preparing an ionic pigment mixture by dispersing a pigment such as carbon black like REGAL 330 ®, HOSTAPERM PINK TM, or PV FAST BLUE TM of from about 2 to about 10 percent by weight of toner in an aqueous mixture containing a cationic surfactant such as dialkylbenzene dialkylammonium chloride, like SANIZOL B-50 TM available from Kao or MIRAPOL TM available from Alkaril Chemicals, of from about 0.5 to about 2 percent by weight of water, utilizing a high shearing device such as a Brinkman Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, styrene butylmethacrylate, PLIOTONE TM or styrene butadiene of from about 88 percent to about 98 percent by weight of the toner, and of about 0.1 micron to about 3 microns polymer particle size in volume average diameter, and counterionic surfactant such as an anionic surfactant such as sodium dodecylsulfate, dodecylbenzenesulfonate or NEOGEN R TM from about 0.5 to about 2 percent by weight of water, a nonionic surfactant such as polyethylene glycol or polyoxyethylene glycol nonyl phenyl ether or IGEPAL 897 TM obtained from GAF Chemical Company of from about 0.5 to about 3 percent by weight of water, thereby causing a flocculation or heterocoagulation of pigment, charge control additive and resin particles; (iii) homogenizing the resulting flocculent mixture with a high shearing device such as a Brinkman Polytron or IKA homogenizer at a speed of from about 3,000 revolutions per minute to about 10,000 revolutions per minute for a duration of from about 1 minute to about 120 minutes, thereby resulting in a homogeneous mixture of latex and pigment and further stirring with a mechanical stirrer from about 250 to 500 rpm to form electrostatically stable aggregates of from about 0.5 micron to about 5 microns in average volume diameter; (iv) diluting the aggregate particle mixture with water from about 50 percent solids to about 15 percent solids; (v) heating the statically bound aggregate composite particles of from about 60° C. to about 95° C. and for a duration of about 60 minutes to about 600 minutes to form toner sized particles of from about 3 microns to about 7 microns in volume average diameter and with a geometric size distribution of from about 1.2 to about 1.4 as measured by the Coulter Counter; and (vi) isolating the toner sized particles by washing, filtering and drying thereby providing a composite toner composition. Flow additives to improve flow characteristics and charge additives to improve charging characteristics may then optionally be adding by blending with the toner, such additives including AEROSILS ® or silicas, metal oxides like tin, titanium and the like, of from about 0.1 to about 10 percent by weight of the toner.

One preferred method of obtaining a pigment dispersion depends on the form of the pigment utilized. In some instances, pigments are available in the wet cake or concentrated form containing water, they can be easily dispersed utilizing a homogenizer or stirring. In other instances, pigments are available in a dry form, whereby dispersion in water is effected by microfluidizing using, for example, a M-110 microfluidizer and passing the pigment dispersion from 1 to 10 times through the chamber, or by sonication, such as using a Branson 700 sonicator, with the optional addition of dispersing agents such as the aforementioned ionic or nonionic surfactants.

Illustrative examples of resin particles selected for the process of the present invention include known polymers selected from the group consisting of poly(styrene-butadiene), poly(para-methyl styrenebutadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadieneacrylic acid), poly(styrene-butadiene-methacrylic acid), PLIOTONE TM available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE TM (Reichhold Chemical Inc), PLASTHALL TM (Rohm & Hass), CYGAL TM (American Cyanamide), ARMCO TM (Armco Composites), ARPOL TM (Ashland Chemical), CELANEX TM (Celanese Eng), RYNITE TM (DuPont), and STYPOL TM. The resin particles selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other effective amounts of resin can be selected.

The resin particles selected for the process of the present invention are preferably prepared from emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, such as dodecanethiol or carbontetrachloride, can also be selected when preparing resin particles by emulsion polymerization. Other processes of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Various known colorants or pigments present in the toner in an effective amount of, for example, from about 1 to about 25 percent by weight of the toner, and preferably in an amount of from about 1 to about 15 weight percent, that can be selected include carbon black, like REGAL 330®; magnetites, such as Mobay magnetites MO8029 TM, MO8060 TM; Columbian magnetites; MAPICO BLACKS TM and surface treated magnetites; Pfizer magnetites, CB4799 TM, CB5300 TM, CB5600 TM, MCX6369 TM; Bayer magnetites, BAYFERROX 8600 TM, 8610 TM; Northern Pigments magnetites, NP-604 TM, NP-608 TM; Magnox magnetites TMB-100 TM, or TMB-104 TM; and other equivalent black pigments. As colored pigments there can be selected known cyan, magenta, yellow, red, green, brown, blue or mixtures thereof. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be selected as pigments with the process of the present invention. The pigments selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in effective amounts of, for example, 0. 1 to about 25 weight percent in embodiments include, for example, nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is, for example, from about 0.01 to about 10 percent by weight, and preferably from about 0.1 to about 5 percent by weight of monomers used to prepare the copolymer resin.

Examples of anionic surfactants selected for the preparation of toners and the processes of the present invention are, for example, sodium dodecylsulfate (SDS), sodium dodecylbenzene sulfonate, sodium dodecylnaphthalenesulfate, dialkyl benzenealkyl, sulfates and sulfonates, abitic acid, available from Aldrich, NEOGEN R TM, NEOGEN SC TM from Kao, and the like. An effective concentration of the anionic surfactant generally employed is, for example, from about 0.01 to about 10 percent by weight, and preferably from about 0.1 to about 5 percent by weight of monomers used to prepare the copolymer resin.

Examples of the cationic surfactants selected for the toners and processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL TM, and ALKAQUAT TM available from Alkaril Chemical Company, SANIZOL TM (benzalkonium chloride), available from Kao Chemicals, and the like, and mixtures thereof. The surfactant is utilized in various effective amounts, such as for example from about 0.1 percent to about 5 percent by weight of water. Preferably the molar ratio of the cationic surfactant used for flocculation to the anionic surfactant used in latex preparation is in range of 0.5 to 4, preferably from 0.5 to 2.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Percentage amounts of components are based on the total toner components unless otherwise indicated.

The following Examples are being submitted to further define various species of the present invention. These Examples are intended to be illustrative only and are not intended to limit the scope of the present invention. Also, parts and percentages are by weight unless otherwise indicated.

GENERAL EXAMPLE

Preparation of the Toner Resin

Emulsion (latex) or microsuspension particles selected for the preparation of toner particles in the aggregation process of the present invention were prepared as follows:

Latex A

176 Grams of styrene, 24 grams of butyl acrylate, 4 grams of acrylic acid, and 6 grams of dodecane thiol were mixed with 300 milliliters of deionized water in which 4.5 grams of sodium dodecyl benzene sulfonate anionic surfactant (NEOGEN R TM which contains 60 percent of active component), 4.3 grams of polyoxyethylene nonyl phenyl ether nonionic surfactant (ANTAROX 897 TM - 70 percent active), and 2 grams of potassium persulfate initiator were dissolved. The emulsion was then polymerized at 70° C. for 8 hours. A latex containing 40 percent solids with a particle size of 106 nanometers, as measured on Brookhaven nanosizer, was obtained. Tg=74° C., as measured on DuPont DSC. $M_w$=46,000 and $M_n$=7,700 as determined on Hewlett Packard GPC. The aforementioned latex was then selected for the toner preparation of Examples I to V and VIII.

Latex B

176 Grams of styrene, 24 grams of butyl acrylate, and 5 grams of dodecane thiol were mixed with 300 milliliters of a water solution of 4.5 grams of sodium dodecyl benzene sulfonate anionic surfactant (60 percent active), 4.3 grams of polyoxyethylene nonyl phenyl ether nonionic surfactant (70 percent active), and 2 grams of potassium persulfate were added as an initiator. The resulting emulsion was polymerized at 70° C. for 8 hours. A latex with a particle size of 93 nanometers, a Tg=75° C., a $M_w$=73,000 and a $M_n$=7,800 was obtained. This latex was then selected for the toner preparation of Example VI.

Latex C

176 Grams of styrene, 24 grams of butyl acrylate, 16 grams of acrylic acid, and 5 grams of dodecane thiol were mixed with 300 milliliters water solution of 4.5 grams of sodium dodecyl benzene sulfonate anionic surfactant (60 percent active), 4.3 grams of polyoxyethylene nonyl phenyl ether nonionic surfactant (70 percent active), and 2 grams of potassium persulfate initiator. The resulting emulsion was polymerized at 70° C. for 8 hours. There resulted a latex with a particle size of 106 nanometers, a Tg=67.5° C., a $M_w$=110,000 and a $M_n$=6,000. The resulting latex was then selected for the preparation of a toner composition. (Example VII).

Latex D

352 Grams of styrene, 48 grams of butyl acrylate, 32 grams of acrylic acid, 12 grams of dodecane thiol and 16 grams of VAZO 52 TM initiator were shaken to dissolve the initiator. The resulting organic phase was homogenized at 10,000 rpm for 2 minutes with 1,200 milliliters of a water solution of 9 grams of sodium dodecyl benzene sulfonate (60 percent active), 10 grams of polyoxyethylenenonylphenyl ether (70 percent active), and 4 grams of potassium iodide were added to prevent emulsion polymerization. The resulting microsuspension was then polymerized at 70° C. for 6 hours. Particles with average particle size of 70 nanometers were obtained with a $M_w$=50,000 and a $M_n$=4,000. These particles were then used for the toner preparation of Examples IX to XI.

PREPARATION OF TONER PARTICLES

EXAMPLE I 2.4 Grams of dry FANAL PINK TM pigment (Rhodamine B type), 10 percent by weight loading, were dispersed in 120 milliliters of deionized water containing 0.5 gram of alkylbenzyldimethyl ammonium chloride cationic surfactant using an ultrasonic probe for 2 minutes. This cationic dispersion of the pigment was than homogenized with a Brinkman probe for 2 minutes at 10,000 rpm, while 60 milliliters of Latex A (40 percent solids, 2 percent acrylic acid) were slowly added. This mixture was diluted with 120 milliliters of water and then was transferred into a kettle. After 24 hours of stirring (250 rpm) at room temperature, about 25° C., microscopic observation evidenced pigmented particle clusters of uniform size indicating aggregation of pigment particles with latex particles and that their growth was achieved. A small sample of 10 grams of particles in water comprised of 90 percent resin styrene, butyl acrylate, acrylic acid, (ST/BA/AA) and 10 percent of pigment was taken and heated up to 80° C. for two hours to coalesce the particles, and their size was then measured on the Coulter Counter. Particles of 9.9 average volume diameter microns were obtained with a GSD=1.16, and a Coulter Counter trace indicated no particles below 4 microns.

The kettle contents were stirred for an additional 24 hours (48 hours total), heated up to 80° C. for two hours to coalesce the particles and the particle size was measured again on the Coulter Counter. Particles (comprised of 90 percent of resin (ST/BA/AA) and 10 percent of pigment) of 10.0 microns were obtained with a GSD=1.16, indicating no further growth in the particle size after all the fines were consumed. The particles were then washed with water and dried. The aforementioned magenta toner particles obtained with 10 percent of the above pigment loading had a Tg=72° C., a $M_w$=43,000 and a $M_n$=12,500. The yield of the toner particles was 98 percent.

EXAMPLE II 2.4 Grams of dry FANAL PINK TM pigment (10 percent loading) were dispersed in 120 milliliters of deionized water containing 0.25 gram of alkylbenzyldimethyl ammonium chloride cationic surfactant using an ultrasonic probe for 3 minutes. This cationic dispersion of the pigment was then homogenized using a Brinkman probe for 2 minutes at 10,000 rpm, while 60 milliliters of Latex A (40 percent solids) were slowly added. This mixture was diluted with 120 milliliters of water and it was then transferred into a kettle. After 24 hours of stirring (250 rpm) at room temperature, microscopic observation shows pigmented particle clusters of uniform size (aggregation of pigment particles with latex particles and their growth was achieved). A small sample, 18 grams, was withdrawn and heated up to 80° C. for two hours to coalesce the particles, and their size was measured on the Coulter Counter. Particles of 6.2 microns were obtained with a GSD=1.33. The number of fines (particles of 1.3 to 4 microns) was above 50 percent. The kettle contents were stirred for an extra 48 hours (96 hours all together), heated up to 80° C. for two hours to coalesce the particles, and the particle size was measured again on the Coulter Counter. Particles of 6.4 microns were obtained with a GSD=1.21, and the number of fines was reduced to 20 percent. After drying, the particles were remeasured to be 6.4 microns (GSD=1.21). The number of fines were around 20 percent in each instance. This indicates that there were no particles (fines) loose during the washing and drying procedure. The aforementioned obtained magenta toner particles with 10 percent pigment loading had a Tg=72° C., a $M_w$=43,000 and a $M_n$=12,500. The yield of toner was 97 percent.

EXAMPLE III 2.4 Grams of dry Yellow 17 pigment (10 percent loading) was dispersed in 120 milliliters of deionized water containing 0.25 gram of alkylbenzyldimethyl ammonium chloride using an ultrasonic probe for 3 minutes. This cationic dispersion of the pigment was then homogenized using a Brinkman probe for 2 minutes at 10,000 rpm, while 60 milliliters of Latex A (40 percent solids) were slowly added. This mixture was diluted with 120 milliliters of water and it was then transferred into a kettle. After 24 hours of stirring (250 rpm) at room temperature, a small sample, 10 grams, was taken and heated up to 80° C. for two hours to coalesce the particles, and their size was measured on the Coulter Counter. Particles of an average 3.6 microns were obtained with a GSD=1.56. At this point 0.25 gram of alkylbenzyldimethyl ammonium chloride (cationic surfactant) was added and the kettle contents were stirred for an extra 24 hours, heated up to 80° C. for two hours to coalesce the particles and the particle size was measured on the Coulter Counter. The resulting toner particles which were comprised of styrene (88 parts), butyl acrylate (12 parts) and acrylic acid (2 parts) and yellow pigment (10 percent by weight of toner) with an average volume diameter of 9.2 microns and a GSD of 1.27 indicate that by increasing the concentration of the counterion surfactant, the particle size can be increased, and the GSD can be improved. The toner particles were then washed by filtration using hot water (50° C.) and dried on the freeze dryer. The prepared toner had a Tg=73° C. (measured on DSC), a $M_w$=43,000 and a $M_n$=12,600 (as measured on GPC). The yield of dry toner particles was 97 percent.

Washing by filtration with hot water and drying with a freeze dryer was utilized in all the Examples unless otherwise indicated; and the resin for all the Examples in the final toner was as indicated in this Example III, unless otherwise noted.

EXAMPLE IV 1.2 Grams of PV FAST BLUE TM pigment (phthalocyanide) (5 percent loading) were dispersed in 120 milliliters of deionized water containing 0.25 gram of alkylbenzyldimethyl ammonium chloride using an ultrasonic probe for 2 minutes. This cationic dispersion of the pigment was then homogenized by a Brinkman probe for 2 minutes at 10,000 rpm, while 60 milliliters of Latex A were slowly added. This mixture was transferred into a kettle. After 72 hours of stirring (250 rpm) at room temperature, a small sample, 10 grams, was taken and heated up to 80° C. for two hours to coalesce the particles, and their size was measured on the Coulter Counter. Particles of 2.8 microns were obtained with a GSD=1.53. At this point, 0.5 gram of alkylbenzyldimethyl ammonium chloride (cationic surfactant) was added and the kettle contents were stirred for an extra 24 hours, heated up to 80° C. for two hours to coalesce the particles and the particle size was measured on the Coulter Counter. Toner particles comprising styrene (88 parts), butyl acrylate (12 parts) and acrylic acid (2 parts), and cyan phthalocyanine pigment (5 percent by weight of toner) of 5.1 microns were obtained with a GSD=1.35 (Coulter Counter measurement). The formed toner particles were washed by filtration and dried on the freeze dryer as in Example III. The toner had a Tg=73° C. (DSC measurement), a $M_w$=43,000 and a $M_n$=12,500 (measured on GPC). The yield of toner was 96 percent.

EXAMPLE V 2.4 Grams of carbon black (REGAL 330 ®) (10 percent loading) were dispersed in 120 milliliters of deionized water containing 0.25 gram of alkylbenzyldimethyl ammonium chloride using an ultrasonic probe for 3 minutes. This cationic dispersion of the pigment was than homogenized by a Brinkman probe for 2 minutes at 10,000 rpm, while 60 milliliters of Latex A (40 percent solids) were slowly added. After stirring for 16 hours in a kettle (by kettle throughout is meant a container of a suitable size, such as 1 liter) and heating at 80° C. for two hours, toner particles comprised of styrene (88 parts), butyl acrylate (12 parts) and acrylic acid (2 parts), and carbon black pigment (10 percent by weight of toner) of 5.4 microns with a GSD=1.24 were obtained (Coulter Counter measurement). The toner particles were washed by filtration and dried on the freeze dryer as in Example III, and the toner had a Tg=73° C., (DSC measurement), $M_w$=58,000 and $M_n$=12,900 (measured on GPC). The yield of toner particles was 95 percent.

EXAMPLE VI 2.4 Grams of dry FANAL PINK TM pigment (10 percent loading) were dispersed in 120 milliliters of deionized water containing 0.25 gram of alkylbenzyldimethyl ammonium chloride using an ultrasonic probe for 2 minutes. This cationic dispersion of the pigment was then polytroned by Brinkman probe for 2 minutes at 10,000 rpm, while 60 milliliters of Latex B (no acrylic acid) were slowly added. This mixture was diluted with 120 milliliters of water and it was then transferred into a kettle. A small sample, 10 grams, was taken at time 0 and heated to coalesce. Coulter Counter measurement indicates 87 percent population of fines (1.3 to 4 microns) at this point and some image aggregates >16 microns. After 72 hours of stirring at room temperature, the kettle contents were heated up to 80° C. for two hours to coalesce the particles. Toner particles of 7.4 microns were obtained with a GSD=1.3. The toner particles were washed and dried as in Example III, and magenta toner particles of styrene (88 parts) and butyl acrylate (12 parts) without acrylic acid containing 10 percent (by weight) of magenta pigment were obtained with a Tg=75° C. (as measured on DSC), a $M_w$=73,000 and a $M_n$=7,800 (measured on GPC). The yield of toner was 95 percent.

EXAMPLE VII 2.4 Grams of dry FANAL PINK TM pigment were dispersed in 120 milliliters of deionized water containing 0.25 gram of alkylbenzyldimethyl ammonium chloride (cationic surfactant) using ultrasonic probe for 2 minutes. This cationic dispersion of the pigment was than homogenized using a Brinkman probe for 2 minutes at 10,000 rpm, while 60 milliliters of Latex C (anionic, 40 percent solids, 8 percent acrylic acid) were slowly added. This mixture was then transferred into a kettle. After 48 hours of stirring at room temperature, no aggregation was observed (99 percent fines). At this point, an extra 0.25 gram of alkylbenzyl dimethyl ammonium chloride was added. The kettle contents were then stirred 72 hours and heated up to 80° C. for two hours to coalesce the particles. Toner particles of styrene (88 parts) and butyl acrylate (12 parts), acrylic acid (8 parts) containing 10 percent (by weight) of magenta pigment of 5.0 microns were obtained with a GSD=1.20 (as measured on the Coulter Counter). This experiment indicates that by increasing the concentration of the polar groups on the surface (acrylic acid concentration) more cationic surfactant was utilized to cause the aggregation (more cationic surfactant to neutralize the higher surface charge of the emulsion due to acrylic acid), reference Example VI without acrylic acid. Also, smaller particles were obtained. The yield of toner particles was 98 percent.

EXAMPLE VIII 6.5 Grams of a wet cake of HOSTAPERM PINK TM pigment were dispersed in 60 milliliters of water by an ultrasonic probe for 1 minute. This dispersion was homogenized using a Brinkman probe (20 millimeters), while 60 milliliters of emulsion A (anionic) were added. After 10 minutes of polytroning, 0.2 gram of cationic surfactant was added while still shearing. The resulting "whipped cream" was then diluted with 120 milliliters of water. After 24 hours stirring at room temperature, the kettle contents were heated up to 75° C. for two hours to coalesce the particles. Toner sized particles of 5.1 with GS, D=1.39 (as measured on the Coulter Counter) were obtained. Those particles comprised of styrene (88 parts), butyl acrylate ( 12 parts) and acrylic acid (2 parts), and quinacridone magenta pigment (10 percent by weight of toner) had a Tg=73° C. (DSC measurement), a $M_w$=43,000 and a $M_n$=12,500 (measured on GPC). The yield of toner particles was 96 percent.

EXAMPLE IX

10 Grams of a wet cake of HOSTAPERM PINK TM pigment were dispersed in 100 milliliters of water by ball-milling for 2 hours. Into this dispersion 150 grams of microsuspension D were added. The slurry was mixed for 3 hours at 1,200 rpm using Greerco homogenizer. Microscopical observation reveals a significant number of fines. At this point 0.2 gram of cationic surfactant (alkylbenzyldimethyl ammonium chloride) was introduced and mixed for 2 hours at 1,200 rpm. The aggregation of particles was observed. The aggregates were heated up to 70° C. for 3 hours to coalesce the particles. The toner particles were then washed and analyzed and the particle size (average volume diameter) was 12.9 microns, and the GSD=1.27 (as measured on Coulter Counter). These toners were particles comprised of styrene (88 parts), butyl acrylate ( 12 parts) and acrylic acid (2 parts), and the quinacridone magenta pigment. The yield of the magenta toner particles was 96 percent.

EXAMPLE X 3.6 Grams of dry PV FAST BLUE TM pigment were dispersed in 200 milliliters of water containing 0.5 gram of alkylbenzyldimethyl ammonium chloride (cationic surfactant) using an ultrasonic probe for 2 minutes. This dispersion was than sheared with a polytron for 1 minute. While polytroning, 200 grams of Latex D (36 percent solids) were added and polytroned for 1 minute. The resulting "creamy" fluid was than stirred at room temperature for 24 hours. A small sample was then taken and heated up to 70° C. for 1 hour while stirring. Particles size measurement indicates 6.7 micron particles with a GSD=1.23. The remaining sample was heated at 70° C. to coalesce. Particles of 10.0 microns with a GSD=1.33 were observed. The toner particles were washed by filtration and dried in a freeze dryer. The yield of toner particles was 95 percent.

EXAMPLE XI 5.4 Grams of dry Yellow 17 pigment (10 percent) were dispersed in 150 milliliters of water containing 0.3 gram of alkylbenzyldimethyl ammonium chloride (cationic surfactant) using an ultrasonic probe for 2 minutes. This dispersion was than polytroned for 1 minute. While polytroning, 150 grams of Latex D (54 grams of solids) were added and polytroned for 1 minute. The resulting "whipped cream" was than diluted with 50 milliliters of water and stirred at room temperature for 24 hours. The toner slurry resulting was than heated up to 70° C. for 1 hour while stirring, the toner particles were washed and dried, and the particle size was measured. Toner particles comprised of styrene (88 parts), butylacrylate (12 parts) and acrylic acid (2 parts), and 10 percent yellow pigment (by weight) and of 11.6 microns with GSD=1.32 (as measured on Coulter Counter) were obtained. The yield of toner particles was 97 percent.

Toner yields with the prior art processes were 60 percent or less, reference for example U.S. Pat. Nos. 4,996,127 and 4,797,339; and with these processes classification was needed to obtain, for example, desirable GSD.

While the invention has been described in detail with reference to specific and preferred embodiments, it will be appreciated that various modifications and variations will be apparent to the artisan. All such modifications and embodiments, as may readily occur to one skilled in the art, are intended to be within the scope of the appended claims.

What is claimed is:

1. A process for the preparation of toner compositions consisting essentially of (i) preparing a pigment dispersion in a solvent, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles to form said toner composition comprised of polymeric resin, pigment and optionally a charge control agent.

2. A process in accordance with claim 1 wherein the surfactant utilized in preparing the pigment dispersion is a cationic surfactant, and the counterionic surfactant present in the latex mixture is an anionic surfactant.

3. A process in accordance with claim 1 wherein the surfactant utilized in preparing the pigment dispersion is an anionic surfactant, and the counterionic surfactant present in the latex mixture is a cationic surfactant.

4. A process in accordance with claim 1 wherein the dispersion of step (i) is accomplished by homogenizing at from about 1,000 revolutions per minute to about 10,000 revolutions per minute at a temperature of from about 25° C. to about 35° C. and for a duration of from about 1 minute to about 120 minutes.

5. A process in accordance with claim 1 wherein the dispersion of step (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

6. A process in accordance with claim 1 wherein the dispersion of step (i) is accomplished by microfluidization in a microfluidizer or in nanojet for a duration of from about 1 minute to about 120 minutes.

7. A process in accordance with claim 1 wherein the homogenization of step (ii) is accomplished by homogenizing at from about 1,000 revolutions per minute to about 10,000 revolutions per minute, and for a duration of from about 1 minute to about 120 minutes.

8. A process in accordance with claim 1 wherein the heating of the statically bound aggregate particles to form toner size composite particles comprised of pigment, resin and optional charge control agent is accomplished at a temperature of from about 60° C. to about 95° C., and for a duration of from about 1 hour to about 8 hours.

9. A process in accordance with claim 1 wherein the resin particles are selected from the group consisting of poly(styrene-butadiene), poly(para-methyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene) terpolymers.

10. A process in accordance with claim 1 wherein the resin particles are selected from the group consisting of poly(styrene-butadieneacrylic acid), poly(styrene-butadiene-methacrylic acid), poly(styrene-butyl methacrylate-acrylic acid), or poly(styrene-butyl acrylate-acrylic acid); PLIOTONE TM, polyethylene-terephthalate, polypropylene-terephthalate, polybutylene-terephthalate, polypentylene-terephthalate, polyhexaleneterephthalate, polyheptadene-terephthalate, and polyoctalene-terephthalate.

11. A process in accordance with claim 1 wherein the resin is comprised of poly(styrene-butadiene).

12. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

13. A process in accordance with claim 1 wherein the anionic surfactant is selected from the group consisting of sodium dodecylsulfate, sodium dodecylbenzenesulfate and sodium dodecylnaphthalenesulfate.

14. A process in accordance with claim 2 wherein the cationic surfactant is a quaternary ammonium salt.

15. A process in accordance with claim 1 wherein the pigment is carbon black, magnetite, or mixtures thereof; cyan, yellow, magenta, or mixtures thereof; or red, green, blue, brown, or mixtures thereof.

16. A process in accordance with claim 1 wherein the resin particles formed in step (ii) are from about 0.01 to 3 microns in average volume diameter.

17. A process in accordance with claim 1 wherein the pigment particles are from about 0.01 to about 3 microns in volume average diameter.

18. A process in accordance with claim 1 wherein the toner particles isolated are from about 3 to 15 microns in average volume diameter, and the geometric size distribution is from about 1.15 to about 1.35.

19. A process in accordance with claim 1 wherein the statically bound aggregate particles formed in step (iii) are from about 1 to about 10 microns in average volume diameter.

20. A process in accordance with claim 1 wherein the nonionic surfactant concentration is about 0.1 to about 5 weight percent of the toner components.

21. A process in accordance with claim 2 wherein the anionic surfactant concentration is about 0.1 to about 5 weight percent of the toner components.

22. A process in accordance with claim 2 wherein the cationic surfactant concentration is about 0.1 to about 5 weight percent of the toner.

23. A process in accordance with claim 1 wherein there is added to the surface of the isolated toner particles surface additives of metal salts, metal salts of fatty acids, silicas, metal oxides, or mixtures thereof, in an amount of from about 0.1 to about 10 weight percent of the obtained toner particles.

24. A process in accordance with claim 1 wherein diluting the flocculated mixture of step (iii) is accomplished with water of from about 50 percent solids to about 15 percent solids.

25. A process in accordance with claim 1 wherein the toner is washed with warm water and the surfactants are removed from the toner surface, followed by drying.

26. A process in accordance with claim 1 wherein the solvent is water.

27. An in situ process for the preparation of toner particles which comprises mixing a dispersion of pigment, ionic surfactant, and optional additives with a latex mixture comprised of a counterionic surfactant with a charge of opposite polarity of said ionic surfactant, resin, and nonionic surfactant, which mixing results in flocculation of pigment, resin, and optional additives; and heating.

28. An in situ process for the preparation of toner particles comprising (i) preparing a pigment dispersion in a solvent, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles to form said toner composition comprised of polymeric resin particles and pigment.

* * * * *